US007788928B2

(12) United States Patent
De Sousa et al.

(10) Patent No.: US 7,788,928 B2
(45) Date of Patent: Sep. 7, 2010

(54) ANNULAR COMBUSTION CHAMBER OF A TURBOMACHINE

(75) Inventors: Mario Cesar De Sousa, Cesson (FR); Didier Hippolyte Hernandez, Quiers (FR); Thomas Olivier Marie Noel, Vincennes (FR)

(73) Assignee: SNECMA, Paris (FR)

( * ) Notice: Subject to any disclaimer, the term of this patent is extended or adjusted under 35 U.S.C. 154(b) by 662 days.

(21) Appl. No.: 11/673,179

(22) Filed: Feb. 9, 2007

(65) Prior Publication Data

US 2007/0186559 A1 Aug. 16, 2007

(30) Foreign Application Priority Data

Feb. 10, 2006 (FR) ..... 06 50475

(51) Int. Cl.
*F02C 1/00* (2006.01)
*F02G 3/00* (2006.01)

(52) U.S. Cl. ..... 60/753

(58) Field of Classification Search ..... 60/752, 60/753, 796, 798, 800, 804
See application file for complete search history.

(56) References Cited

U.S. PATENT DOCUMENTS 2,544,538 A * 3/1951 Mahnken et al. ..... 138/113
3,854,503 A 12/1974 Nelson et al.
4,543,781 A * 10/1985 Rice ..... 60/804
5,025,622 A 6/1991 Melconian
6,647,729 B2 * 11/2003 Calvez et al. ..... 60/753
2002/0184889 A1 * 12/2002 Calvez et al. ..... 60/796

FOREIGN PATENT DOCUMENTS

EP 0 706 009 A2 4/1996

OTHER PUBLICATIONS

U.S. Appl. No. 11/672,236, filed Feb. 7, 2007, De Sousa, et al.

* cited by examiner

*Primary Examiner*—Michael Cuff
*Assistant Examiner*—Andrew Nguyen
(74) *Attorney, Agent, or Firm*—Oblon, Spivak, McClelland, Maier & Neustadt, L.L.P.

(57) ABSTRACT

Annular combustion chamber of a turbomachine is provided. The combustion chamber includes an inner wall, an outer wall, a chamber bottom disposed between the walls in the upstream region of the chamber, and two attachment flanges disposed downstream of the chamber bottom and respectively enabling the walls to be attached to other parts of the turbomachine. Each wall is divided into several adjacent sectors and each sector is attached to the chamber bottom and to one of the attachment flanges. Advantageously, the adjacent sectors overlap at their lateral edges and there exists a degree of radial play between two adjacent sectors. In addition, the lateral edges of the sectors are inclined circumferentially relative to the principal axis of the combustion chamber.

8 Claims, 4 Drawing Sheets

ANNULAR COMBUSTION CHAMBER OF A TURBOMACHINE

BACKGROUND OF THE INVENTION

1. Field of the Invention

The invention relates to an annular combustion chamber of a turbomachine, of the type including an inner wall, an outer wall, a chamber bottom disposed between said walls in the upstream region of said chamber, and two attachment flanges disposed downstream of the chamber bottom and respectively enabling said walls to be attached to other parts of the turbomachine, generally inner and outer casings surrounding the combustion chamber.

2. Description of Related Art

Formerly, said inner and outer walls of the chamber were made of metal or metal alloy and it was necessary to cool these walls to enable them to withstand the temperatures reached during operation of the turbomachine.

Today, so as to reduce the air flow allocated to the cooling of these walls, the latter are made of ceramic material rather than metal. Ceramic materials are effectively better at withstanding high temperatures and have a lower bulk density than the metals customarily used. The gains made in terms of cooling air and weight result in improved efficiency of the turbomachine. It will be noted that the ceramic materials used are, preferably, ceramic matrix composites chosen for their good mechanical properties.

With regard to the chamber bottom and the attachment flanges, the state of the technology requires that these components be made of metal or metal alloy, rather than ceramic material, thereby facilitating the use of known and proven fixing methods making it possible to fix the attachment flanges to the metallic casings of the combustion chamber and the injection systems to the chamber bottom. These fixings can be made, for example, by welding or bolting.

The ceramics used to make the walls often have a coefficient of expansion around three times lower than that of the metallic materials used to make the chamber bottom and said flanges. A difference of this magnitude generates stresses in the assembled components during the assembly thereof, and also when their temperature rises in operation. These stresses can be the cause of cracking in the attachment flanges or in the walls, (if the flanges are not sufficiently flexible), the ceramic materials being rather brittle by nature.

To remedy this problem, a solution described in the document FR 2 855 249 consists in providing a plurality of flexible fixing lugs connecting the chamber bottom to said walls, these lugs being capable of deforming elastically in relation to the differential expansion between the components.

Other known solutions are described in patent applications FR 2 825 781 and FR 2 825 784, which consist in connecting the walls to the casings of the combustion chamber by means of several resiliently deformable flexible fixing lugs replacing the annular attachment flanges.

In all of these prior art documents, the inner and outer walls of the combustion chamber are made in one piece of generally conical shape.

The principal drawback of known structures with flexible fixing lugs lies in the poor dynamic behaviour of these fixing lugs, during operation of the turbomachine, and it is often necessary to provide damping systems to limit the deformation of these lugs and the vibration generated.

Moreover, in FR 2 855 249, there remains between the fixing lugs, at the level of the chamber bottom, spaces into which fresh air rushes, which can degrade the efficiency of the combustion chamber by promoting the formation of polluting emissions such as, for example, incomplete combustion products and/or carbon monoxide.

SUMMARY OF THE INVENTION

The invention aims to overcome these drawbacks, or at least to mitigate them, and proposes as its object a combustion chamber having a structure alternative to the structures with flexible fixing lugs, that is capable of adapting to the differential expansion between the inner and outer walls, on one hand, and the chamber bottom and the attachment flanges, on the other hand.

To achieve this purpose, the invention discloses an annular combustion chamber of the type cited hereinbefore, characterised in that each wall of the chamber is divided into several adjacent sectors, each sector being attached to the chamber bottom and to one of the attachment flanges.

By virtue of the sectorisation of the walls, the latter are able to deform in relation to the expansion of the chamber bottom and the attachment flanges (this expansion being greater than that of the walls). For example, in the event of a rise in temperature, during which the chamber bottom and/or the attachment flanges expand (i.e. their diameters increase), the adjacent sectors of the walls move apart circumferentially so that the diameters of these walls increase. The creation of thermomechanical stresses in these elements is thus avoided.

Advantageously, the wall sectors are not attached to the chamber bottom and to the attachment flanges via flexible attachments but are, on the contrary, attached rigidly to these elements, for example by bolting. Thus, the structure exhibits better dynamic behaviour in operation than a structure with flexible fixing lugs.

Advantageously, the wall sectors are provided with lateral edges and the lateral edges of two adjacent sectors overlap, thereby limiting the passage of fresh air, between the sectors, from the outside to the inside of the combustion chamber. In effect, if it is not controlled, such a passage of air results in too much air entering the chamber, which is conducive to the formation of polluting emissions such as, for example, incomplete combustion products and carbon monoxide, thereby reducing the efficiency of the chamber. On the other hand, if it is controlled, this passage of air can be used to cool the walls, as explained below.

Advantageously, the aim is to cool the inner surfaces of the inner and outer walls. It is therefore necessary that a certain volume of fresh air reaches these surfaces.

A known solution consists in forming a multitude of small perforations in said walls, through which calibrated volumes of fresh air pass. These are generally referred to as multiperforations. This solution nevertheless has the drawback of significantly increasing the production cost of said walls and of significantly reducing the mechanical behaviour and damage characteristics thereof.

To remedy this additional problem, an object of the invention is to propose an alternative to the multiperforations, which is also more cost-effective.

This object is achieved by virtue of the fact that there exists a degree of radial play (i.e. in a direction perpendicular to the axis of rotation of the turbomachine) between two adjacent overlapping sectors, this play allowing the passage of fresh air from the outside to the inside of said chamber so as to cool the inner surface of at least one of the sectors.

In this manner, the fresh air arriving from the outside of the chamber does not penetrate radially to the inside of the latter because the sectors are covering each other: it penetrates circumferentially by moving along, at least partially, the inner surface of the inner and outer walls, thereby cooling them. Furthermore, by adjusting this radial play, the quantity of cooling air entering the inside of the chamber can be controlled.

To increase the surface area of the inner faces of the walls to which this cooling action is imparted, the lateral edges of the sectors are inclined circumferentially relative to the principal axis of the combustion chamber, this principal axis corresponding to the axis of rotation of the rotor of the turbomachine.

In the present patent application, the circumferential direction at a point on the surface of a wall of the chamber is defined as being the direction of the tangent to the wall, at this point, in a plane perpendicular to the axis of rotation of the turbomachine. Thus, when the inner and outer walls are of generally conical shape, it is considered that a lateral edge of a sector is inclined circumferentially relative to the axis of rotation of the turbomachine, when this edge is inclined relative to a generatrix of the wall concerned.

It will be noted that the presence of radial play between the sectors is not, in itself, incompatible with the presence of multiperforations in these sectors.

The invention and its advantages will be better appreciated by reading the following detailed description of a non-limitative example of a combustion chamber according to the invention. The description refers to the attached drawings.

DETAILED DESCRIPTION OF THE INVENTION

Figure 1:
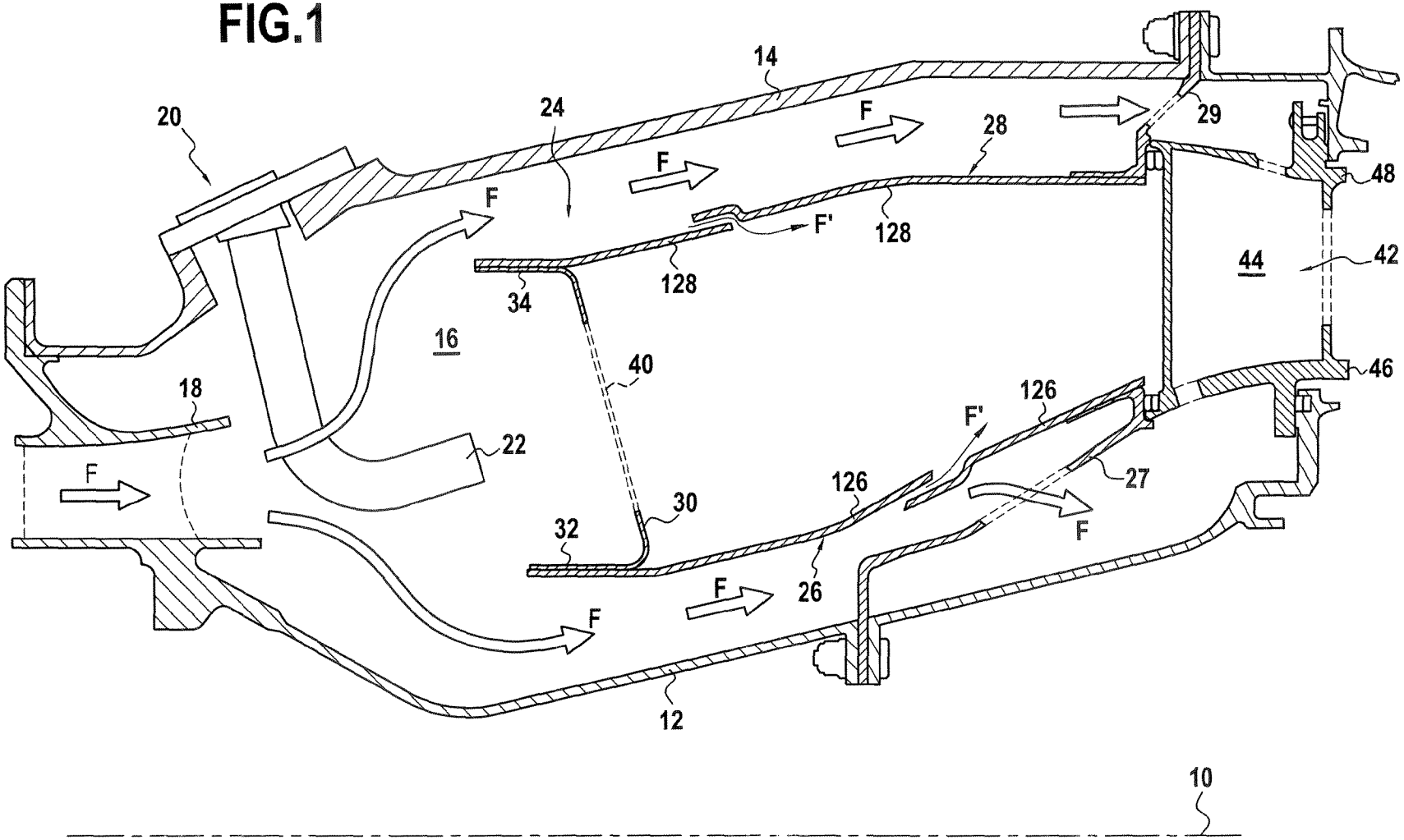
FIG. 1 is a schematic view, in axial half cross-section, of part of a turbomachine equipped with a combustion chamber according to the invention.

FIG. 1 shows part of a turbomachine (turbojet, turboprop or terrestrial gas turbine) in axial half cross-section, including:

- an inner circular enclosure, or inner casing 12, of principal axis 10 corresponding to the axis of rotation of the rotor of the turbomachine, said casing being made of metal alloy;
- an outer circular enclosure, or outer casing 14, coaxial, also made of metal alloy;
- an annular space 16 between the two casings 12 and 14 receiving the compressed comburant, generally air, originating upstream from a compressor (not shown) of the turbomachine, through an annular diffusion conduit 18.

Figure 2:
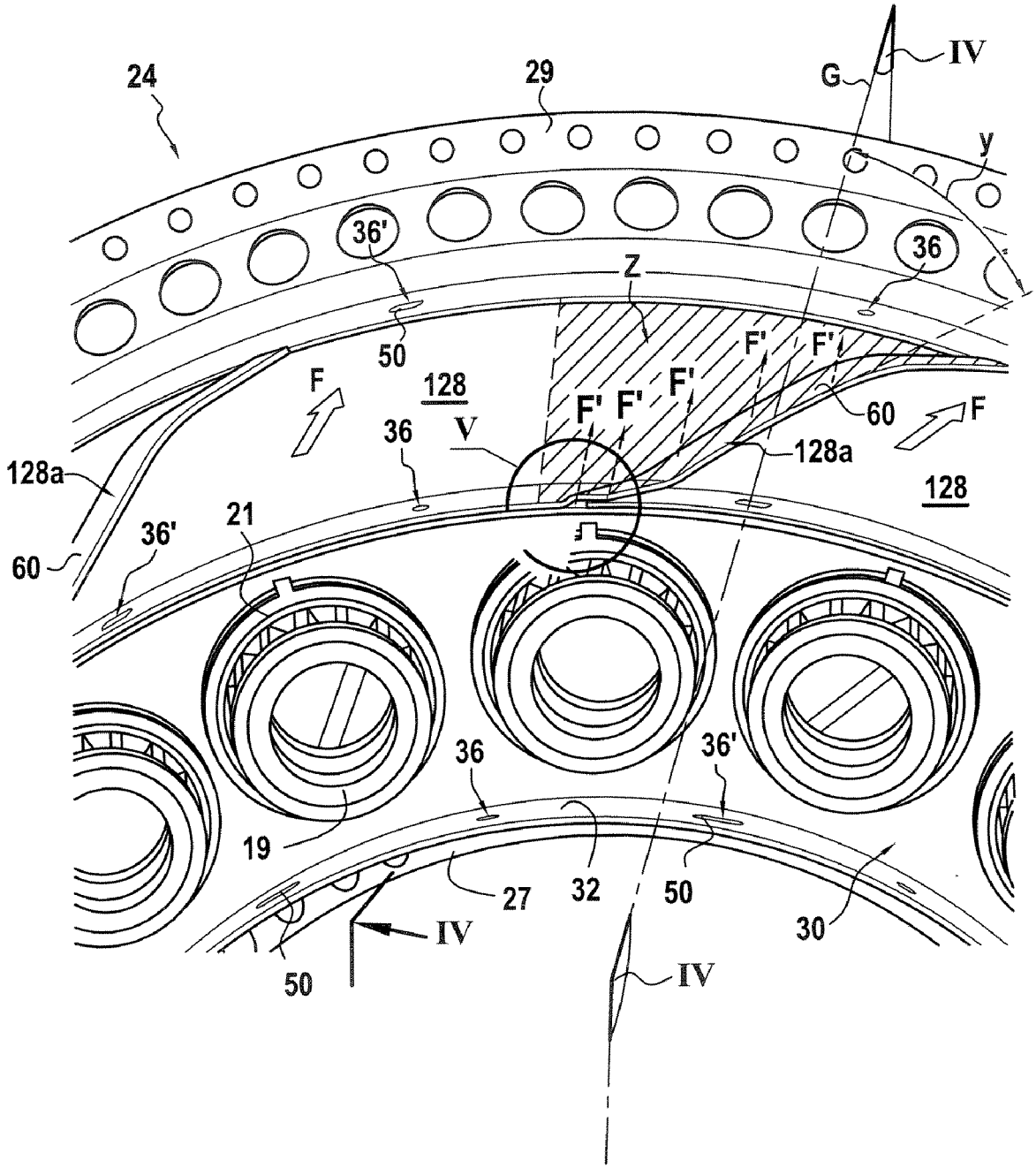
FIG. 2 is a partial perspective view of the combustion chamber in FIG. 1, seen from upstream.
Figure 3:
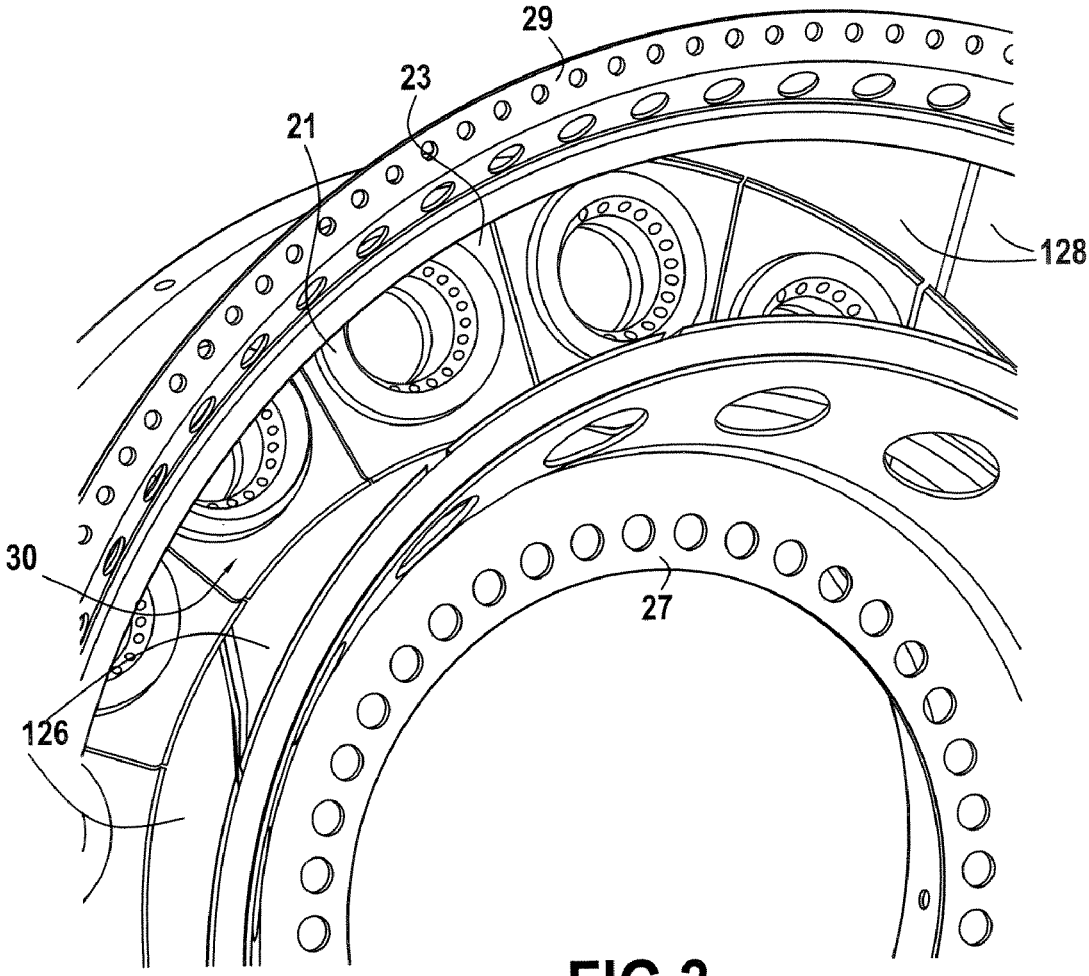
FIG. 3 is a partial perspective view of the combustion chamber in FIG. 1, seen from downstream.

The space 16 includes, from the upstream side to the downstream side of the combustion chamber (upstream and downstream being defined in relation to the normal flow of the gases inside the turbomachine as indicated by the arrows F):

- an injection assembly formed by a plurality of injection systems 20 evenly spaced around the conduit 18 and each including a fuel injection nozzle 22 fixed on the outer casing 14 (for the sake of simplicity, the retaining system 19, the mixer 21 and the optional baffle 23, associated with each injection nozzle 22 are not shown in FIG. 1, but these components do appear in FIGS. 2 and 3);
- a combustion chamber 24 including a radially inner circular wall 26 and a radially outer circular wall 28, both coaxial of axis 10, and a transverse wall which constitutes the bottom 30 of this combustion chamber and which includes two returns 32 and 34 attached respectively to the upstream ends of the walls 26, 28. This chamber bottom 30 is provided with through orifices 40 to facilitate the injection of fuel and a part of the oxidiser into the combustion chamber;
- inner 27 and outer 29 attachment flanges, respectively connecting the inner and outer walls 26 and 28 to the inner and outer casings 12 and 14; and
- an annular distributor 42 made of metal alloy forming a high pressure turbine inlet stage (not shown) and conventionally including a plurality of fixed blades 44 mounted between an inner circular platform 46 and an outer circular platform 48. The distributor 42 being secured to the casings 12 and 14 of the turbomachine by suitable fixing means.

The chamber bottom 30 and the attachment flanges 27 and 29 are made of metal alloy, whereas the walls 26 and 28 of the chamber 24 are made of ceramic matrix composite material.

The walls 26 and 28 are respectively divided into several adjacent sectors 126 and 128. Each sector 126 (128) is attached to the chamber bottom 30, on one hand, and to one of the attachment flanges 27 (29), on the other hand. At least one of these sectors can be provided with multiperforations.

In operation, the chamber bottom 30 can have a tendency to rotate about the principal axis 10 and to become angularly offset relative to the flanges 27 and 29. To prevent this, each wall sector 126 (128) is attached to the chamber bottom 30 or to one of the attachment flanges 27 (29) at two points of attachment, at least. Thus, each sector 126 (128) is prevented from pivoting in relation to the chamber bottom and/or to said flange, thereby preventing the angular offset of the chamber bottom 30. In the example, each sector 126 (128) is attached to the chamber bottom 30 and to an attachment flange 27 (29), at two points of attachment 36 and 36'.

Figure 4:
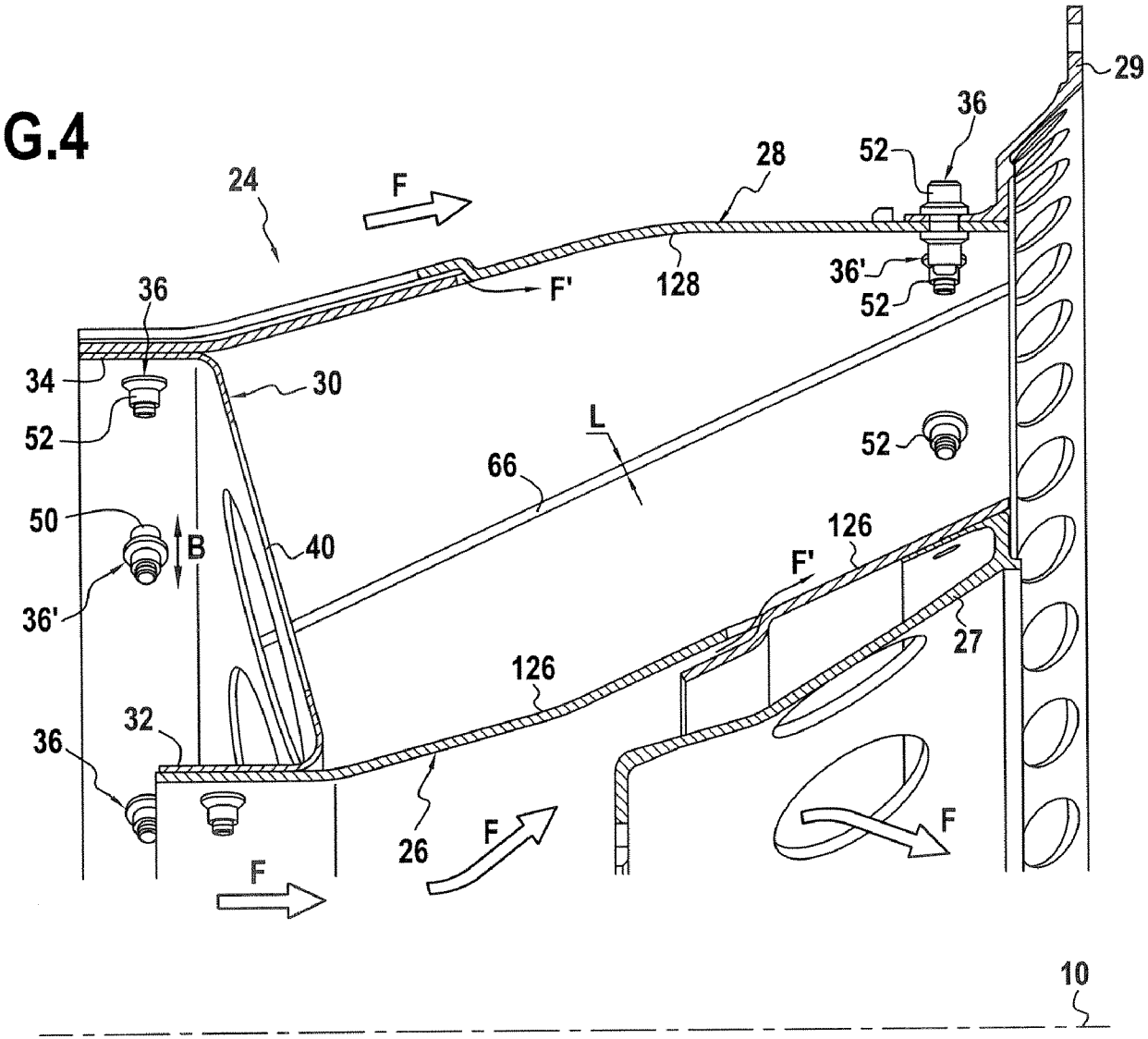
FIG. 4 is an axial half cross-section of the combustion chamber in FIG. 2, in the plane IV-IV.

Advantageously, at least one of these two points of attachment 36' is made by bolting, by passing a bolt 52 through at least one oblong hole 50. This oblong hole 50 can be formed in the return 32 (34) of the chamber bottom 30, in the sector 126 (128) or in these two parts at the same time. This oblong hole 50 is oriented circumferentially and the bolt 52 can therefore move circumferentially inside the hole 50 as indicated by the double arrow B in FIG. 4. In the example depicted in the Figures, all of the points of attachment 36, 36' are made by bolting but only one fixing point 36' in two is made by bolting through an oblong hole 50. To simplify the figures, only FIG. 4 depicts bolts 52.

By virtue of this type of fixing, when the chamber bottom 30 or the flanges 27, 29, expand or contract according to the temperature, the fixing points 36, 36' move apart or closer together and the creation of thermomechanical stresses in each wall sector 126, 128 is avoided.

In reference to FIGS. 2 and 5, the particular manner in which the lateral edges 128*a* (126*a*) of two adjacent wall sectors 128 (126) overlap will now be described. Each sector 128 (126) includes a lip 60 extending along one of its lateral edges 128*a* (126*a*), preferably, substantially over the full length thereof. The other lateral edge of the sector is devoid of a lip and will be referred to hereinbelow as the plain edge 128*b* (126*b*).

The lip 60 projects relative to one of the faces (inner or outer) of the sector 128 (126), so as to be able to cover the plain edge 128*b* (126*b*) of the adjacent sector. In other words, the lip 60 is offset radially inwards or outwards relative to the sector 128. In the example illustrated in FIG. 5, the lip 60 projects (outwardly) relative to the outer face of the sector 128. Alternatively, it can project (inwardly) relative to the inner face of the sector. The outer and inner faces 126, 128 being turned respectively towards the outside and inside of the combustion chamber 24.

The lip 60 can be formed directly during the manufacture of the sector 128 (126), or at a machining stage after its manufacture. The lip 60 can also consist of a strip fitted, for example by bonding, onto the lateral edge 128*a* (126*a*) of the sector.

Figure 5:
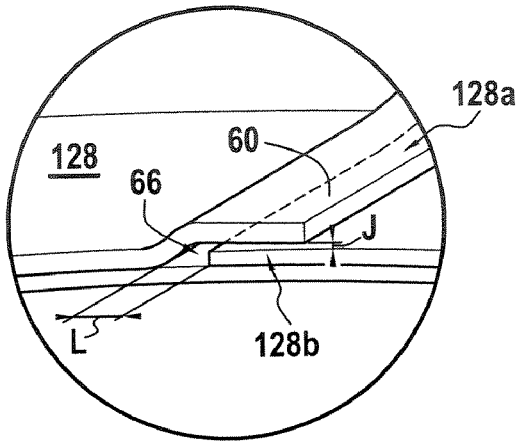
FIG. 5 is a detail view indicated by the reference mark V in FIG. 2.

In the different instances, there exists a radial play J, positive or negative, between the lip 60 and the surface of the plain edge 128*b* (126*b*), as shown in FIG. 5. When it is positive, this play J allows the passage of fresh air in the direction of the arrows F' from the outside to the inside of the chamber 24. This fresh air passes between the lip 60 and the plain edge 128*b*, then through the slot 66 which exists between two adjacent sectors, the width L of this slot 66 being variable in relation to the spacing of the sectors 128 (126). In fact, the width L varies as a function of the differential expansion between the chamber bottom 30, the attachment flanges 27, 29 and the wall segments 126, 128. Thus, the higher the temperatures inside the chamber 24, the further the sectors 128 (126) move apart (L increases) and the better the cooling action. The cooling capacity of the chamber walls therefore adapts to the temperatures inside the latter. Such an adaptation of cooling makes it possible to reduce the quantity of cooling air taken in, when the temperatures inside the chamber are low. A system provided only with multiperforations does not afford such an advantage.

The fresh air circulates outside the chamber 24 in the direction of the arrows F shown in FIG. 1, i.e. in a direction more axial than radial. The play J and the slot 66 form a passage which imparts relatively little deviation to the flow of fresh air F' entering the combustion chamber 24. Thus, this air flow F' remains sufficiently inclined relative to the radial direction as shown in FIGS. 1 and 4 so as, on one hand, to disturb the combustion process inside the chamber 24 as little as possible and, on the other hand, to create a protective film of fresh air along the inner face of the wall segments 126, 128, thereby limiting the temperature rise of these segments.

In another aspect of the invention and in reference to FIG. 2, the lateral edges 126*a*, 126*b*, 128*a*, 128*b* of the sectors 126, 128, are inclined circumferentially relative to the principal axis 10 of the combustion chamber. As indicated hereinbefore, this circumferential inclination corresponds to an inclination of angle y of the lateral edges relative to the generatrices G of the walls 126, 128. The flow of fresh air F, which circulates outside the chamber 24, travels in the upstream to downstream direction. The fact of inclining the lateral edges 126*a*, 126*b*, 128*a*, 128*b* and therefore the fresh air intake slots 66 serves to distribute the fresh air flow F' entering the chamber 24 over a larger cooling zone Z than if said lateral edges were oriented on a generatrix G. This cooling zone Z is shown shaded in FIG. 2. The more the lateral edges 126, 128 are inclined, the more the zone Z is extended, and the better the cooling of the wall sectors 126, 128.

Thus, by virtue of the invention, it is possible to control the cooling of the walls 126, 128 by, on one hand, adjusting the play J and the width L of the slots 66 and, on the other hand, by adjusting the inclination y of these slots relative to the principal axis 10.

The invention claimed is:

1. An annular combustion chamber of a turbomachine, having a principal axis, said combustion chamber comprising:

an inner wall, an outer wall, a chamber bottom disposed between said inner and outer walls in an upstream region of said combustion chamber, and two attachment flanges disposed downstream of a bottom of the combustion chamber and respectively enabling said inner and outer walls to be attached to other parts of the turbomachine, wherein each of the inner and outer walls is divided into several adjacent sectors, each sector being attached to the bottom of the combustion chamber and to one of the attachment flanges, wherein the lateral edges of the sectors are inclined circumferentially relative to said principal axis, and wherein the bottom of the combustion chamber and the attachment flanges are made of metal, whereas the wall sectors are made of ceramic matrix composite material.

2. A combustion chamber according to claim 1, wherein the lateral edges of two adjacent sectors overlap.

3. A combustion chamber according to claim 2, wherein there exists a radial play between two adjacent overlapping sectors, the radial play allowing the passage of fresh air from the outside to the inside of said combustion chamber.

4. A combustion chamber according to claim 1, wherein each sector includes a lip extending along one of its lateral edges, the lip projecting relative to one of the faces of the sector and covering the lateral edge of the adjacent sector.

5. A combustion chamber according to claim 1, wherein each wall sector is attached to the chamber bottom or to one of the attachment flanges at two points of attachment, at least.

6. A combustion chamber according to claim 5, wherein at least one of said points of attachment corresponds to an attachment by bolting through at least one oblong hole.

7. A combustion chamber according to claim 1, wherein at least one of the sectors is provided with multiperforations.

8. A turbomachine including a combustion chamber according to claim 1.

* * * * *